United States Patent [19]

Robinson

[11] Patent Number: 4,910,852

[45] Date of Patent: Mar. 27, 1990

[54] WHEEL PULLING DEVICE

[75] Inventor: . James E. Robinson, Georgetown, Tex.

[73] Assignee: Georgetown Railroad Co., Inc., Georgetown, Tex.

[21] Appl. No.: 242,560

[22] Filed: Sep. 12, 1988

[51] Int. Cl.[4] ..... B25B 27/14

[52] U.S. Cl. ..... 29/281.1

[58] Field of Search ..... 254/33–38; 211/20, 22; 104/263, 264, 273, 274; 188/32; 29/281.1

[56] References Cited

U.S. PATENT DOCUMENTS

| | | | |
|---|---|---|---|
| 983,983 | 2/1911 | Derosa | 104/273 |
| 2,158,352 | 5/1939 | Brown | 104/273 |
| 2,339,399 | 1/1944 | Henricks | 254/43 |
| 2,980,035 | 4/1961 | Cole et al. | 104/273 |
| 3,459,280 | 8/1969 | Grimm | 188/32 |
| 3,533,335 | 10/1970 | Biddison | 188/32 |
| 4,095,679 | 6/1978 | Walker | 188/32 |

*Primary Examiner*—Robert C. Watson
*Attorney, Agent, or Firm*—Harrison & Egbert

[57] ABSTRACT

A device for the replacement of wheels on trains comprising a generally flat framework having a longitudinal opening extending therethrough, a first wheel receiving area rigidly affixed to the framework for abutting a surface of a wheel, and a second wheel receiving area rigidly affixed to the framework and disposed distal from the first wheel receiving area on the framework. The longitudinal opening receives the periphery of a train wheel. The framework includes a first longitudinal member, a second longitudinal member, and a transverse member rigidly connected across the longitudinal members for maintaining the longitudinal members in parallel alignment. The longitudinal opening has a width sufficient, in combination with the thickness of the longitudinal members, to cause the periphery of the train wheels to raise above the top surface of a railroad track. The wheel receiving areas comprise a plurality of abutment members positioned for the receipt of train wheels removed from a train and of replacement train wheels. Pull rings are rigidly affixed at the ends of the framework for attachment to an external pulling mechanism.

14 Claims, 2 Drawing Sheets

WHEEL PULLING DEVICE

TECHNICAL FIELD

The present invention relates to devices for the removal and replacement of wheels from trains.

BACKGROUND ART

In U.S. patent application Ser. No. 047,005, entitled "Self-Unloading Train For Bulk Commodities", a conveyor system is described that allows the rapid removal of bulk commodities from a plurality of hopper cars connected as a unit. The unit train is pulled by a conventional locomotive. Each of the hopper cars may include several hoppers having bottom discharge openings and associated gates for discharging onto an endless belt conveyor which runs the entire length of the train. A trailer car includes a transfer conveyor which receives the material from the train conveyor. As this self-unloading train moves along the straight section of track, the material may be deposited in a windrow alongside the track by the transfer conveyor. Alternatively, the unit train may be unloaded while stationary, with the transfer conveyor discharging onto a portable stacking conveyor. Other techniques are also suitable for the unloading of such a train.

In this self-unloading train, each of the hopper cars is rigidly coupled to adjacent hopper cars. This rigid coupling is required so as to maintain the proper operation and stability of the underlying conveyor system. Without rigid coupling, the conveyor belt would deteriorate rapidly because of the continual flexing between cars.

There are many other situations where the cars of a train must be rigidly coupled. Unfortunately, the rigid coupling of cars in a unit train makes it very difficult to replace the wheels of the train. In the past, this has involved a complex method of operation.

In ordinary trains, each of the cars is uncoupled from the adjacent cars and is transferred to a wheel replacement facility. At such a facility, the individual car can be jerked up, replacement wheels aligned beneath the car, and the car lowered so as to receive the replacement wheels. Since the coupling of this type of trains is a common procedure, there is no added complexity with this form of wheel replacement technique.

In rigidly coupled cars, wheel replacement presents a more difficult problem. Since each of the cars is rigidly coupled to an adjacent car, it is quite difficult to separate the rigidly coupled cars for the purpose of transferring such car to a wheel replacement facility. It is additionally difficult to "jack up" the unit train for the purpose of the wheel replacement on an individual car. A great deal of height is required for such wheel replacement. In addition, a great deal of manual manipulation is required so as to remove the present wheels and for the introduction of the replacement wheels.

It is an object of the present invention to provide a wheel pulling device that allows the wheels of a railroad car to be replaced quickly, easily, and efficiently.

It is another object of the present invention to provide a wheel pulling device that eliminate the need for the transfer of the railroad car to a wheel removal facility.

It is another object of the present invention to provide a wheel pulling device that allows wheels to be replaced at remote locations.

It is still a further object of the present invention to provide a wheel pulling device that is inexpensive to manufacture and simple to use.

These and other objects and advantages of the present invention will become apparent from a reading of the attached specification and appended claims.

SUMMARY OF THE INVENTION

The present invention is a device for the replacement of wheels on a train comprising a first longitudinal member and a second longitudinal member. The first and second longitudinal members are in parallel relation to each other. These longitudinal members are connected by a plurality of crossmembers that maintain this parallel relation. These first and second longitudinal members define a longitudinal opening for the receiving of train wheels. The first and second longitudinal members have a thickness and the longitudinal opening has a width of proper relation so as to cause the lowermost part of the train wheels to be higher than the uppermost point of the adjacent railroad track. After experimentation, it was found that the longitudinal opening should have a width of approximately four inches and the first and second longitudinal members should have a thickness of approximately three-eights of an inch.

A first pull ring is rigidly affixed to one end of the first and second longitudinal members. A second pull ring is rigidly affixed to the other end of the first and second longitudinal members. These pull rings are for the purpose of connecting the wheel pulling device of the present invention to an external source of pulling power, such as a forklift or a truck.

The present invention further comprises a first wheel receiving area for receiving a pair of train wheels from the train. This first wheel receiving area has at least one abutment member affixed to the first and second longitudinal members for the purpose of being placed in juxtaposition against the surface of a train wheel. A second wheel receiving area serves to receive a pair of replacement train wheels. The second wheel receiving area has an angle member rigidly affixed to the first and second longitudinal members. This angle member has a surface suitable for juxtaposition against the surface of the replacement train wheels.

The present invention also includes a method of replacing train wheels that comprises the steps of: (1) replacing the wheel pulling device across the top of the railroad tracks adjacent the two-be-replaced pair of wheels on the railroad car; (2) lifting the railroad car such that the pair of wheels separates from the railroad car; (3) moving the removed pair of wheels such that the pair of wheels rests in the longitudinal opening above the top surface of the tracks within a first wheel receiving area; (4) placing a replacement pair of wheels into a second wheel receiving area on the wheel pulling device; (5) pulling the wheel pulling device across the railroad tracks such that the pair of wheels passes from beneath the railroad car and that the replacement pair of wheels resides in the former position of the removed pair of wheels; (6) lowering the railroad car such that the railroad car receives the replacement pair of wheels; and (7) moving the railroad car such that the replacement pair of wheels passes from the longitudinal opening of the second wheel receiving area.

DETAILED DESCRIPTION OF THE INVENTION

Figure 1:
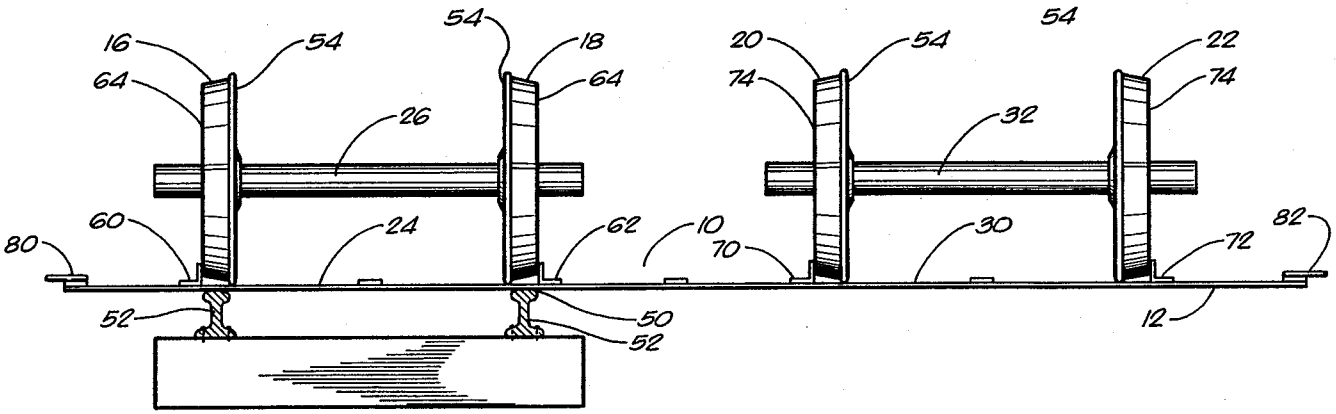
FIG. 1 is a view in side elevation of the wheel pulling device of the present invention.
Figure 2:
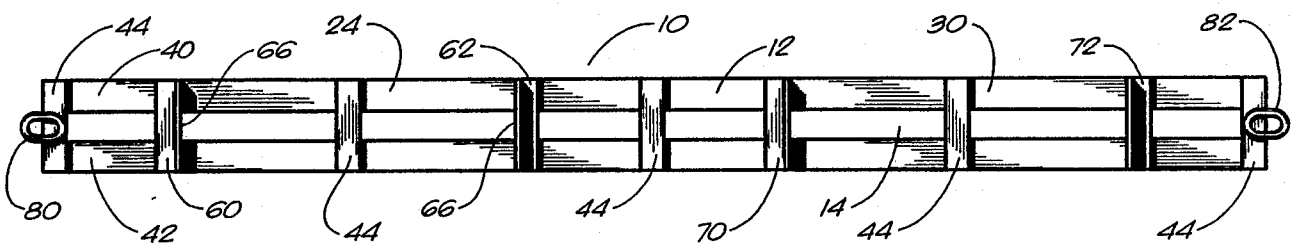
FIG. 2 is a top view of the wheel pulling device of the present invention.
Figure 3:
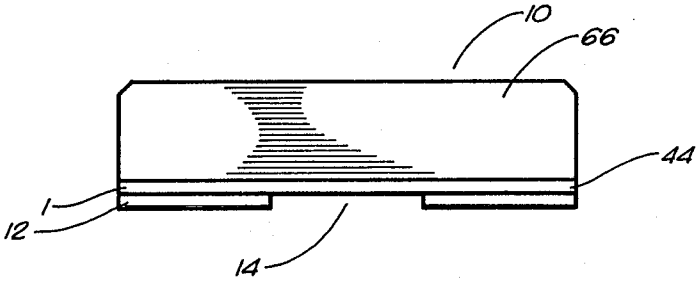
FIG. 3 is an end view of the wheel pulling device of the present invention.

Referring to FIGS. 1–3, there is shown at 10 the wheel pulling device of the present invention. Wheel pulling device 10 has a generally flat framework 12 having a longitudinal opening 14. As shown in FIG. 1, longitudinal opening 14 receives the periphery of train wheels 16, 18, 20, and 22. A first wheel receiving area 24 is formed on the framework 12 for the purpose of receiving the train wheels 16 and 18 as connected by common axle 26. The second wheel receiving area 30 is also rigidly affixed to the framework 12 and is distal the first wheel receiving area 24. The second wheel receiving area 30 receives the replacement train wheels 20 and 22 as connected by common axle 32.

The framework 12 includes a first longitudinal member 40, a second longitudinal member 42, and a plurality of transverse members 44 rigidly connected across the first longitudinal member 40 and the second longitudinal member 42. Transverse members 44 maintain the first longitudinal member 40 and the second longitudinal member 42 in parallel alignment. The longitudinal opening 14 extends between the first longitudinal member 40 and the second longitudinal member 42. In this arrangement, the first longitudinal member 40 and the second longitudinal member 42, in combination with the longitudinal opening 14, have a thickness and width sufficient to cause a train wheel to raise above the top surface 50 of an adjacent railroad track 52. In one embodiment, the longitudinal opening 14 has a width of four inches and the first longitudinal member 40 and the second longitudinal member 42 have a thickness of three-eights of an inch. It should be kept in mind that the width of the longitudinal opening 14 and the thickness of the longitudinal members 40 and 42 can assume various configurations. The main criterion is that these components are suitable to raise the periphery 54 of train wheels 16, 18, 20, and 22 above the top surface of track 52. The countervailing factors affecting this combination include the ability to position the train wheels onto the longitudinal opening 14, the ability to push the train wheels over an edge of the wheel pulling device 10, and the ability to maintain the replacement wheels 20 and 22 onboard the wheel pulling device 10.

The first wheel receiving area 24 has a first abutment member 60 and a second abutment member 62. The first abutment member 60 is rigidly connected to the longitudinal members 40 and 42 transverse to the longitudinal opening 14. The second abutment member 62 is rigidly connected in a similar fashion distal from the first abutment member 60. The first abutment member 60 and the second abutment member 62 are separated by a distance generally corresponding to the distance between the outer surfaces 64 of train wheels 16 and 18. As used in the preferred embodiment, these abutment members 60 and 62 comprise $12'' \times 3'' \times 3'' \times \frac{3}{8}''$ angle irons. The abutment surfaces 62 and 66 face each other in position on the wheel pulling device 10. Ideally, these abutment surfaces 66 should be separated by a distance of approximately sixty-six and one quarter inches.

The second wheel receiving area 30 has a configuration similar to that of the first wheel receiving area 24. In particular, the second wheel receiving area 30 includes third abutment member 70 and fourth abutment member 72. Third abutment member 70 and fourth abutment member 72 are rigidly connected transverse to the longitudinal opening 14 of the wheel pulling device 10. These third and fourth abutment members 70 and 72 are also separated by a distance generally corresponding to the distance between surface 74 on the replacement wheels 20 and 22. In any case, the third and fourth abutment members 70 and 72 are separated by a distance equal to the distance separating the first abutment member 60 and the second member 62.

The transverse members 44, the first abutment member 60, the second abutment member 62, the third abutment member 70, and the fourth abutment member 72 are all welded to the longitudinal members 40 and 42 transverse to longitudinal opening 14. This welding is accomplished to make a secure and solid apparatus for the wheel pulling device 10 of the present invention.

An attachment member 80 is fastened to one end of framework 12. The attachment member 80 is attached to the framework so that the framework may be connected to an external source of pulling power. In particular, this attachment member 80 is a pull ring that is welded to the framework. A second pull ring 82 is fastened to the other end of framework 12. In use, these pull rings 80 and 82 may be connected, by suitable hooks, chains, or other means, to a tractor, a forklift, a truck, or other source of external pulling power. Since train wheels have great weight, the source of pulling power should be sufficient to draw the wheels from under the train and to pull the replacement wheels into position beneath the railroad car.

The method of replacing these wheels on a train is also a unique aspect of the present invention. Initially, the wheel pulling device 10 is drawn across the top 50 of railroad track 52 adjacent a pair of wheels 16 and 18 of a railroad car. One side of the framework 12 should be in relatively close abutment to the outer periphery 54. This can be accomplished by sliding the wheel pulling device 10 toward the periphery 54 on the tracks. Secondly, the railroad car is lifted such that the wheels 16 and 18 separate from the railroad car. The railroad car may be lifted by jacking or other pneumatic or hydraulic action. Once the railroad car is lifted from the wheels 16 and 18 and the no longer encumbered axle 26, the wheels 16 and 18 are ready for replacement.

After removal from the railroad car, the wheels 16 and 18 may be rolled onto the wheel pulling device 10 such that their outer periphery 54 rests in the longitudinal opening 14 of the framework 12. As the wheels 16 and 18 are moved over the framework, the wheels 16 and 18 will lift over the thickness of the framework 12 and, eventually, come to rest in the longitudinal opening 14. As stated previously, it is important that the outer periphery 54 be at a level slightly higher than the top surface 50 of tracks 52.

It is necessary, at some stage during the previous steps, to place the replacement wheels 20 and 22, on common axle 32, into the second wheel receiving area 30 of the framework 12. In the simplest manner, this can be accomplished by simply rolling the wheels onto the framework 12 such that the wheels 20 and 22 rest in the longitudinal opening 14. When the original wheels 16 and 18 and the replacement wheels 20 and 22 are in the position illustrated in FIG. 1, a truck, or other source of external power, connects to the pull ring 80. The truck may then begin pulling the device 10 such that the surface 66 of abutment member 62 will abut the outer surface 64 of wheel 54. Similarly, the surface of abutment member 72 will encounter the surface 74 of wheel 22 so as to move the wheels 16, 18, 20, and 22 in correspondence with the movement of framework 12. In this manner, the original wheels 16 and 18 are removed from under the railroad car and the replacement wheels 20 and 22 are drawn into position over tracks 52.

The original wheels can then be pulled off of the framework 12 for repair, exchange, or scrapping. In the meantime, the replacement wheels 20 and 22 are in position to be received by the railroad car. The railroad car may then be lowered so that the truck of the railroad car receives the axle 32 of the replacement wheels 20 and 22. After the axle 32 is received by the railroad car, the railroad car may be moved such that the replacement pair of wheels passes from the longitudinal opening 14 over the longitudinal member 42. Following this replacement, replacement wheels 20 and 22 are in condition for proper use by the railroad car.

Alternatively, the replacement wheels 20 and 22 are drawn into position onto the railroad track 52. When in this proper position, the wheels can be rolled from the longitudinal opening 14 and onto the tracks 52. The wheel pulling device 10 can then be totally removed from the tracks. After that step, the wheels can be rolled into the proper position to be received by the trucks of the railroad car. The railroad car may then be lowered so that the truck receives the axle 32 of the replacement wheels 20 and 22.

The present invention offers an expeditious manner of changing the wheels of a railroad car. This device eliminates the need for special facilities for wheel removal. This is particularly important when the railroad car is part of a unit train. Since the unit train is difficult to disassemble, the present invention offers a technique whereby wheels can be removed without the disassembly of the unit train.

The present invention offers efficiency and expediency in the change of wheels. One motion causes the replacement wheels to be brought into the position of the original wheels. No complicated manipulation of the wheels, or the railroad car is required. As such, the present invention saves money by offering greater manpower efficiency and effectiveness. The present invention also offers a significant cost savings over other, more complicated, apparatus and techniques for the removal of railroad wheels. The present invention is comprised of readily available materials that can be assembled in a simple fashion by welding and/or machining. The device is also transportable and may accompany the railroad car in its travel.

The foregoing disclosure and description of the invention is illustrative and explanatory thereof, and various changes in the methods steps, as well as in the details of the illustrated apparatus, may be made within the scope of the appended claims, without departing from the true spirit of the invention. The present invention should only be limited by the following claims and the their legal equivalents.

I claim:

1. A device for replacing wheels on trains comprising:

a generally flat framework having a longitudinal opening, said longitudinal opening for receiving the periphery of a train wheel, said framework comprising:

a first longitudinal member;

a second longitudinal member, said longitudinal opening extending between said first longitudinal member and said second longitudinal member, said first and second longitudinal members having a thickness and said longitudinal opening having a width sufficient to cause said train wheel to raise above the top surface of an adjacent railroad track; and a transverse member rigidly connected across said first longitudinal member and said second longitudinal member, said transverse member for maintaining said first longitudinal member and said second longitudinal member in parallel alignment;

a first wheel receiving means rigidly affixed to said framework for abutting a surface of said train wheels; and a second wheel receiving means rigidly affixed to said framework and disposed distal of said first wheel receiving means on said framework, said second wheel receiving means for abutting a surface of a replacement train wheel.

2. The device of claim 1, said longitudinal opening having a width of four inches, said first and second longitudinal members having a thickness of three-eighths inch.

3. A device for replacing wheels on trains comprising:

a generally flat framework having a longitudinal opening, said longitudinal opening for receiving the periphery of a train wheel;

a first wheel receiving means rigidly affixed to said framework for abutting a surface of said train wheels, said first wheel receiving means comprising:

a first abutment member rigidly connected transverse to said longitudinal opening; and a second abutment member rigidly connected transverse to said longitudinal opening, said first and second abutment members separated by a distance generally corresponding to the distance between the outer surfaces of train wheels connected to a common train axle; and a second wheel receiving means rigidly affixed to said framework and disposed distal of said first wheel receiving means on said framework, said second wheel receiving means for abutting a surface of a replacement train wheel.

4. The device of claim 3, said first abutment member and said second abutment member having surfaces facing each other, said abutment surfaces separated by a distance of approximately sixty-six and one-quarter inches.

5. The device of claim 3, said second wheel receiving means comprising:

a third abutment member rigidly connected transverse to said longitudinal opening; and a fourth abutment member rigidly connected transverse to said longitudinal opening, said third and fourth abutment members separated by a distance generally corresponding to the distance between wheels connected to a replacement train axle.

6. The device of claim 5, said third abutment member and said fourth abutment member being separated by a distance equal to the distance of separation between said first abutment member and said second abutment member.

7. The device of claim 5, said first, second, third, and fourth abutment members being angle irons, said surfaces in abutment with said train wheels having a height of at least three inches.

8. The device of claim 1, further comprising:

a plurality of transverse members extending between said first longitudinal member and said second longitudinal member, said transverse members welded to a surface of said longitudinal members, said first and second wheel receiving means welded to the top surface of said first and second longitudinal members.

9. A device for replacing wheels on trains comprising:

a generally flat framework having a longitudinal opening, said longitudinal opening for receiving the periphery of a train wheel;

a first wheel receiving means rigidly affixed to said framework for abutting a surface of said train wheels;

a second wheel receiving means rigidly affixed to said framework and disposed distal of said first wheel receiving means on said framework, said second wheel receiving means for abutting a surface of a replacement train wheel; and attachment means fastened to an end of said framework, said attachment means for connecting said framework to an external source of pulling power.

10. The device of claim 9, said attachment means comprising:

a first pull ring rigidly affixed to one end of said framework; and a second pull ring rigidly affixed to the other end of said framework.

11. A device for replacing train wheels comprising:

a first longitudinal member;

a second longitudinal member in parallel relation to said first longitudinal member, said first and second longitudinal members being connected by a plurality of crossmembers, said first and second longitudinal members defining a longitudinal opening for the receiving of said train wheels, said first and second longitudinal members having a thickness and said longitudinal opening having a width of proper relationship so as to cause the lowermost part of said train wheels to be higher than the uppermost part of the adjacent railroad track, and attachment means connected at the end of said first and second longitudinal members, said attachment means for connecting said device to an external source of pulling power.

12. The device of claim 11, said longitudinal opening having a width of four inches and said first and second longitudinal openings having a thickness of three-eighths inch.

13. The device of claim 11, said attachment means comprising:

a first pull ring rigidly affixed to one end of said first and second longitudinal members; and a second pull ring rigidly affixed to the other end of said first and second longitudinal members.

14. A device for replacing train wheels comprising:

a first longitudinal member;

a second longitudinal member in parallel relation to said first longitudinal member, said first and second longitudinal members being connected by a plurality of crossmembers, said first and second longitudinal members defining a longitudinal opening for the receiving of said train wheels, said first and second longitudinal members having a thickness and said longitudinal opening having a width of proper relationship so as to cause the lowermost part of said train wheels to be higher than the uppermost part of the adjacent railroad track; and a first wheel receiving area for receiving a pair of train wheels from said train, said first wheel receiving area having an abutment member affixed to said first and second longitudinal members for juxtaposition against a surface of said wheels.

* * * * *